US005089372A

United States Patent [19]

Kirihata et al.

[11] Patent Number: 5,089,372

[45] Date of Patent: Feb. 18, 1992

[54] TRANSFER RECORDING MEDIUM UTILIZING DIAZO OR AZIDE COMPOUNDS WHEREIN LIGHT ENERGY IS CONVERTED TO HEAT ENERGY

[75] Inventors: Yoshihiro Kirihata; Chikara Murata, both of Shizuoka; Masahide Tsukamoto; Yutaka Nishimura, both of Osaka, all of Japan

[73] Assignees: Tomoegawa Paper Co., Ltd., Tokyo; Matsushita Electric Industrial Co., Ltd., Kadoma, both of Japan

[21] Appl. No.: 439,014

[22] Filed: Nov. 20, 1989

Related U.S. Application Data

[63] Continuation of Ser. No. 91,966, Sep. 1, 1987, abandoned.

[30] Foreign Application Priority Data

| | | | |
|---|---|---|---|
| Sep. 1, 1986 | [JP] | Japan | 61-205608 |
| Sep. 1, 1986 | [JP] | Japan | 61-205609 |
| Dec. 25, 1986 | [JP] | Japan | 61-307838 |
| Jun. 16, 1987 | [JP] | Japan | 62-147940 |

[51] Int. Cl.[5] ..... G03C 1/695; G03C 1/52; G03C 5/18

[52] U.S. Cl. ..... 430/167; 430/141; 430/151; 430/162; 430/175; 430/194; 430/252; 430/253; 430/254; 430/945

[58] Field of Search ..... 430/252, 253, 254, 162, 430/167, 141, 151, 194, 175, 945

[56] References Cited

U.S. PATENT DOCUMENTS

| | | | |
|---|---|---|---|
| 4,120,722 | 10/1978 | Okomoto et al. | 430/151 |
| 4,340,657 | 7/1982 | Rowe | 430/253 |
| 4,347,300 | 8/1982 | Shimazu et al. | 430/253 |
| 4,388,628 | 6/1983 | Moriguchi et al. | 346/76 PH |
| 4,503,095 | 3/1985 | Seto et al. | 427/265 |
| 4,549,824 | 10/1985 | Sachdon et al. | 430/194 |
| 4,572,684 | 2/1986 | Sato et al. | 400/240.4 |

FOREIGN PATENT DOCUMENTS

| | | | |
|---|---|---|---|
| 874356 | 5/1971 | Canada . | |
| 986773 | 4/1976 | Canada | 430/254 |
| 0117407 | 9/1984 | European Pat. Off. . | |
| 57-22030 | 5/1982 | Japan . | |
| 59-42999 | 3/1984 | Japan . | |

OTHER PUBLICATIONS

Bruce, C. A., IBM Technical Disclosure Bulletin, vol. 18, No. 12, 5/1976, p. 4142.

Derwent Abstract #582022030, first Japan publication data of 8/1979.

Patent Abstracts of Japan, vol. 9, No. 249, Oct. 5, 1985, JP-A-58-209736 (Ricoh K.K.).

Patent Abstracts of Japan, vol. 8, No. 5, Jan. 11, 1984, JP-A-57-53399 (Ricoh K.K.).

Patent Abstracts of Japan, vol. 8, No. 174, Aug. 10, 1984, JP-A-57-178375.

*Primary Examiner*—Charles L. Bowers, Jr.
*Assistant Examiner*—Christopher G. Young
*Attorney, Agent, or Firm*—Cushman, Darby & Cushman

[57] ABSTRACT

A transfer recording medium is disclosed, comprising a light transmitting support having provided thereon a heat transfer solid ink layer via an interlayer having a photolyzable compound. The recording medium provides a clear and high-quality color image on an image-receiving sheet at high speed and low cost irrespective of surface smoothness of the image-receiving sheet.

13 Claims, 3 Drawing Sheets

TRANSFER RECORDING MEDIUM UTILIZING DIAZO OR AZIDE COMPOUNDS WHEREIN LIGHT ENERGY IS CONVERTED TO HEAT ENERGY

This is a continuation of application Ser. No. 07/091,966, filed Sept. 1, 1987, which was abandoned upon the filing hereof.

FIELD OF THE INVENTION

This invention relates to a transfer recording medium suitable for recording characters or images with high resolving power, in particular to a transfer recording medium suitable for color recording, and a method of transfer recording using the same.

BACKGROUND OF THE INVENTION

The recent development of office automation has demanded various terminals. Inter alia, recording devices for converting electrical signals to visual images, so-called printers, enjoy an increasing demand, but a few of the conventional recording devices are satisfactory in performances. Currently employed recording systems include an ink jet system, an electrophotographic system, a heat transfer system, and the like. However, use of a liquid ink or a powder, e.g., toner, makes maintenance and operation of the devices complicated, or a thermal head used has a short life time or achieves only a low printing speed.

An electrical discharge transfer recording technique is known to be one of means for forming images having a relatively high resolving power. In this connection, Japanese Patent Publication No. 19819/70 discloses a thermographic copying process, and Japanese Patent Publication No. 22030/82 discloses a transfer medium.

The conventional electrical discharge transfer technique will be described below with reference to the accompanying drawings.

FIG. 1 illustrates a cross section of the conventional electrical discharge transfer medium, in which light reflecting layer 2 is provided on support 1 and light-heat converting layer 3 and heat transfer solid ink layer 4 are provided in this order on the reverse side of the support 1. A surface roughening layer (not shown) may be provided between the support 1 and the light reflecting layer 2 to facilitate and stabilize destruction of the light reflecting layer 2 upon electrical discharge.

FIGS. 2 to 4 each shows a recording process by the use of the recording medium of FIG. 1. In these figures, numerals 5, 6, and 7 indicate an image-receiving sheet, a xenon lamp, and a flash light, respectively, and other have the same meanings as in FIG. 1. In carrying out recording, the light reflecting layer 2 is removed in accordance with an information pattern to be recorded by a well-known discharge destruction technique as shown in FIG. 2. The image-receiving sheet 5 is intimately contacted with the heat transfer solid ink layer 4, and the flash light 7 containing ultraviolet rays, visible rays, and infrared rays emitted from the xenon flash lamp 6 is irradiated on the light reflecting layer 2 as shown in FIG. 3. The flash light 7 irradiated on areas where the light reflecting layer 2 remains is reflected, while that on areas where the light reflecting layer 2 has been removed passes through the support 1 and reaches the light-heat converting layer 3, where the flash energy is absorbed and effectively converted to a heat energy. The heat transfer solid ink 4 on the light-heat converting layer 3 is thereby fused or sublimated by the heat energy and transferred and fixed onto the image-receiving sheet 5 to obtain transferred image 8 as shown in FIG. 4-(*a*).

Further, *IBM Technical Disclosure Bulletin,* Vol. 18, No. 12, 4142 (1976, May) discloses a thermal laser transfer printing process. This process comprises converting a laser beam based on an image information on an ink sheet comprising a support having provided thereon a heat transfer solid ink layer and converting the laser light energy to a heat energy by the action of the ink, to thereby imagewise transfer and fix the ink to an image-receiving sheet disposed in intimate contact with the heat transfer solid ink layer, similarly to the electrical discharge transfer technique.

The above-described conventional electrical discharge transfer techniques succeeded to obtain a relatively clear image having a desired density and substantial faithfulness to an original by the discharge destruction recording when an image-receiving sheet has a high surface smoothness as shown in FIG. 4-(*a*). However, when an image-receiving sheet of low surface smoothness, such as commonly employed papers, e.g., copying paper, and bond paper for business use, is used, the ink transfer is restricted to contact points between the ink layer and the image-receiving sheet and their vicinities as shown in FIG. 4-(*b*), resulting in a failure of transfer of a solid image or a fine line image.

Transferred image quality might be improved by lowering the melting point or melt viscosity of a heat-fusible binder or lowering the temperature at which a subliming coating starts to sublime. Such attempts, however, cause unresolved transfer called bridging phenomenon or unnecessary transfer at relatively low temperatures, leading to reduction in preservability and background stains (fog).

A great feature of the electrical discharge transfer system resides in faithfulness and sharpness of transferred characters or images at high resolving power. However, images obtained by the use of the aforesaid conventional transfer media often have fat edges due to smearing or blur and are, therefore, inferior in image quality such as contrast or sharpness.

In full color recording, it is required to achieve tone reproduction of each primary color. However, the conventional electrical discharge transfer media involves a difficulty in faithfully transferring the tone obtained by discharge destruction. In some detail, when tone reproduction is effected by a variable area method, such as a dither method, in forming a pattern by electrical discharge, the irradiation area of a flash energy to be absorbed in an ink layer or a light heat converting layer can be controlled in agreement with a dot density to be recorded. Nevertheless, sufficient tone reproduction cannot be achieved due to poor definition upon transfer. That is, a transfer recorded density tends to be saturated at a given level, failing to realize tone reproduction at high density.

Similarly to the electrical discharge transfer system, the heat transfer system making use of a laser beam has a problem of poor ink transfer properties onto an image-receiving sheet having a low surface smoothness and, therefore, inevitably requires papers having high surface smoothness, which naturally leads to an increased printing cost. In this system, the ink transfer properties to an image-receiving sheet of low surface smoothness might be improved by raising the laser beam energy or increasing contact pressure between the ink sheet and the image-receiving sheet, but such makes a recording device large-sized and expensive.

SUMMARY OF THE INVENTION

In the light of the above-mentioned circumstances, the inventors have conducted extensive investigations. As a result, it has now been found that these problems can be solved by a transfer recording medium comprising a light transmitting support having provided thereon a heat transfer solid ink layer via an interlayer containing a photolyzable compound, and a method of transfer recording comprising intimately contacting an image-receiving sheet with the heat transfer solid ink layer of the above-described medium, irradiating the back side of the medium with a light energy according to an image information to be recorded to thereby selectively melt the heat transfer solid ink layer and transfer the molten ink to the image-receiving sheet, and separating the medium and the image-receiving sheet to obtain an image on the image-receiving sheet.

BRIEF DESCRIPTION OF THE ACCOMPANYING DRAWINGS

FIG. 1 illustrates a cross section of a conventional transfer recording medium;

FIGS. 2 to 4 each illustrates a conventional transfer recording system;

FIG. 5 illustrates a cross section of a transfer recording medium according to the present invention; and FIGS. 6 to 8 each shows a method for transfer recording according to the present invention.

DETAILED DESCRIPTION OF THE INVENTION

Figure 1:
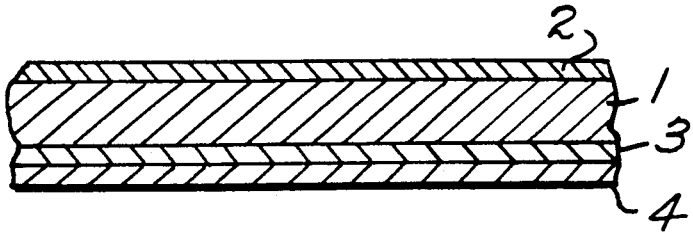
Fig. 1. (PRIOR ART)
Figure 2:
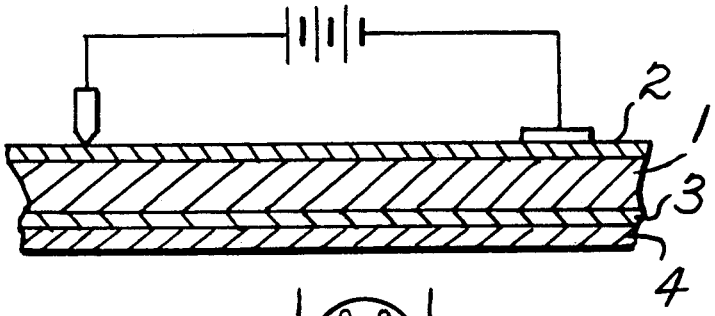
Fig. 2. (PRIOR ART)
Figure 3:
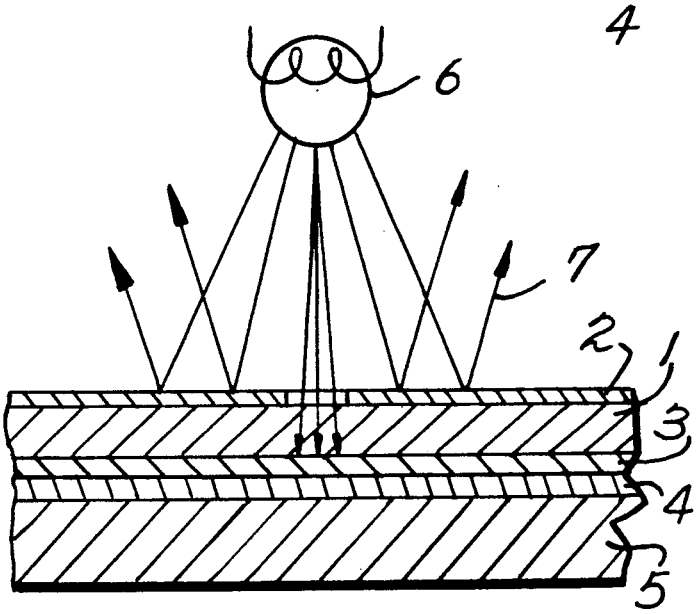
Fig. 3. (PRIOR ART)
Figure 4A:
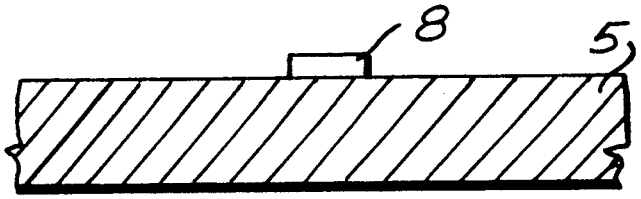
Fig. 4A. (PRIOR ART)
Figure 4B:
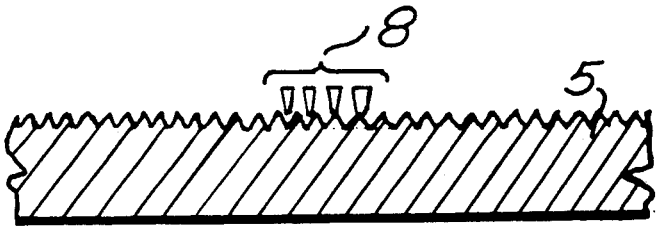
Fig. 4B. (PRIOR ART)
Figure 5A:
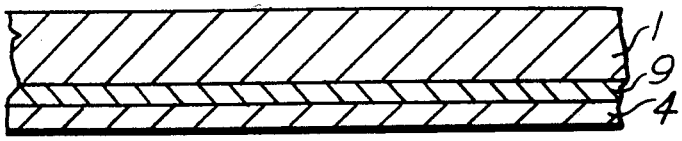
Figure 5B:
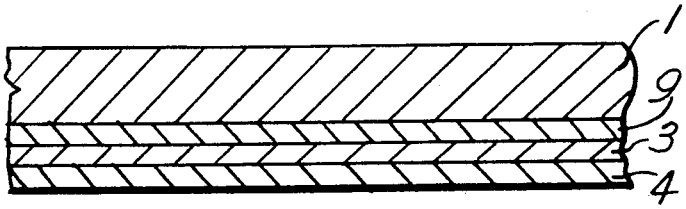
Figure 5C:
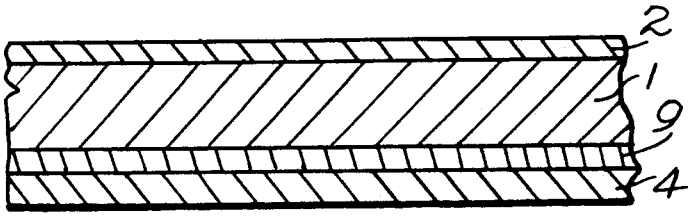
Figure 5D:
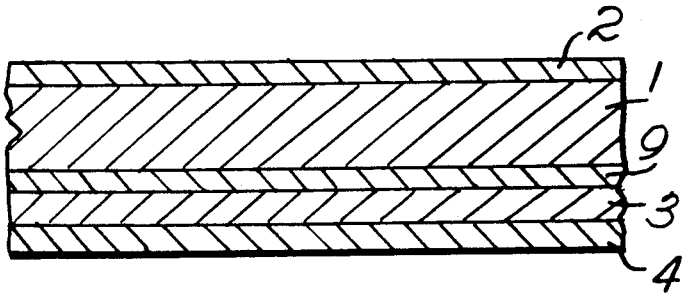

The transfer recording medium according to the present invention will be explained with reference to FIG. 5. The recording medium according to the present invention essentially comprises light transmitting support 1 having provided thereon heat transfer solid ink layer 4 via interlayer 9 containing a photolyzable compound as shown in FIG. 5-(*a*). The recording medium shown in FIG. 5-(*b*) has the same layer structure as in FIG. 5-(*a*) except for further comprising light-heat converting layer 3 between the interlayer 9 and the heat transfer solid ink layer 4. The recording medium shown in FIG. 5-(*c*) has the same layer structure as in FIG. 5-(*a*) except for further comprising light reflecting layer 2 on the back side of the light transmitting support 1. The recording medium shown in FIG. 5-(*d*) has the same layer structure as in FIG. 5-(*a*) except for further comprising light reflecting layer 2 on the back side of the light transmitting support 1 and light-heat converting layer 3 between the interlayer 9 and the heat transfer solid ink layer 4.

Examples of the light transmitting support 1 which can be used in the present invention include films of various heat resistant resins, e.g., polyethylene terephthalate, polyimide, polycarbonate, cellophane, aromatic amides, etc. The support 1 suitably has a thickness of from 1 to 100 μm and preferably from 4 to 30 μm.

The interlayer as referred to in the invention comprises a photolyzable compound dissolved or dispersed in a binder. Binders to be used in the interlayer are preferably selected from thermoplastic resins, waxes, and rubbers.

The thermoplastic resins preferably include thermoplastic elastomers. Examples of the thermoplastic resins to be used include organic solvent-soluble resins such as olefinic resins (e.g., polyethylene, polypropylene, polybutylene, polybutadiene, etc.), acrylic resins (e.g., polymethyl methacrylate, ethylene/ethyl acrylate copolymers, etc.), styrenic resins (e.g., polystyrene, AS resin, BS resin, ABS resin, etc.), vinyl resins (e.g., polyvinyl chloride, polyvinylidene chloride, polyvinyl acetate, ethylene/vinyl acetate copolymers, polyvinyl butyral, vinylidene chloride/acrylonitrile copolymers, vinyl chloride/vinyl acetate copolymers, vinyl chloride/vinylidene chloride copolymers, propylene/vinyl chloride copolymers, etc.), polyamide resins (e.g., nylon 6, nylon 66, nylon 12, etc.), saturated polyester resins, polycarbonate resins, polyacetal resins, polyphenylene oxide resins, polyphenylene sulfide resins, polysulfone resins, polyurethane resins, fluorine-containing resins (e.g., tetrafluoroethylene resins, trifluoroethylene resins, polyvinylidene fluoride, etc.), cellulosic resins (e.g., ethyl cellulose, cellulose acetate, nitrocellulose, etc.), epoxy resins, ionomer resins, and rosin derivative resins; water-soluble resins such as gelatin, glue, hydroxyethyl cellulose, carboxymethyl cellulose, methyl cellulose, carboxymethylhydroxyethyl cellulose, hydroxyethyl starch, gum arabic, saccharose octaacetate, ammonium alginate, sodium alginate, polyvinyl alcohol, polyvinyl butyral, polyvinylpyrrolidone, polyvinylamine, polyethylene oxide, polystyrenesulfonic acids, polyacrylic acids, water-soluble polyamides, and isobutylene/maleic anhydride copolymers; and emulsions of the above-enumerated organic solvent-soluble resins.

Specific examples of waxes include vegetable waxes such as candelilla wax, carnauba wax, rice wax, Japan wax, jojoba oil, etc.; animal waxes such as beeswax, lanolin, spermaceti, etc.; mineral waxes such as montan wax, ozokerite, ceresin, etc.; petroleum waxes such as paraffin wax, microcrystalline wax, petrolatum, etc.; synthetic hydrocarbons such as Fischer-Tropsh wax, polyethylene wax, etc.; modified waxes such as montan wax derivatives, paraffin wax derivatives, microcrystalline wax derivatives, etc.; hydrogenated waxes such as hydrogenated castor oil, hydrogenated castor oil derivatives, etc.; 12-hydroxystearic acid; stearamide; higher alcohols; and mixtures thereof or mixtures of these waxes with organic or inorganic substances.

Specific examples of the rubbers include natural rubber, isoprene rubber, styrene/butadiene rubber (SBR), butadiene rubber, acrylonitrile/butadiene rubber, butyl rubber, ethylene/propylene rubber, chloroprene rubber, acrylic rubber, chlorosulfonated poylethylene rubber, hydrin rubber, urethane rubber, polysulfide rubber, silicone rubber, fluorine-containing rubber, and mixtures thereof or mixtures of these rubbers with organic or inorganic substances.

These binders for the interlayer may be used either individually or in combination of two or more thereof.

The photolyzable compound to be incorporated in the interlayer is a compound capable of being decomposed rapidly upon irradiation with light including ultraviolet rays, visible rays, and infrared rays and suitably includes diazo compounds and axide compounds. The diazo compounds and azide compounds to be used are required to be uniformly dissolved or dispersed in the interlayer; to be photolyzed at a high rate while effectively releasing nitrogen gas; and to have resistance to thermal or mechanical shocks.

The diazo compound which meets these requirements includes those conventionally employed in the field of diazo copying materials. Specific examples of such diazo compounds are 4-diazo-1-dimethylaminobenzene, 4-diazo-1-diethylaminobenzene, 4-diazo-1-dipropylaminobenzene, 4-diazo-1-methylbenzylamino-benzene, 4-diazo-1-dibenzylamino-benzene, 4-diazo-1-ethylhydroxyaminobenzene, 4-diazo-1-diethylamino-3-methoxybenzene, 4-diazo-1 dimethylamino-2-methyl-benzene, 4-diazo-1-benzoylamino-2,5-diethoxybenzene, 4-diazo-1-morpholinobenzene, 4-diazo-1-morpholino-2,5-dimethoxybenzene, 4 diazo-1-morpholino-2,5-diethoxybenzene, 4-diazo-1-morpholino-2,5-dibutoxybenzene, 4-diazo-1-morpholino-2,5-diisopropoxybenzene, 4-diazo-1-anilinobenzene, 4-diazo-1-dimethylamino-3-carboxybenzene, 4-diazo-1-toluylmercapto-2,5-diethoxybenzene, 4-diazo-1,4-dimethoxybenzoylamino-2,5-diethoxybenzene, 4-diazo-1-pyrrolidino-3-methyl-benzene, 4-diazo-1-pyrrolidino-2-methylbenzene, 4 diazo 1-dimethylamino-2-(4-chlorophenoxy)-5-chlorobenzene, etc.

These diazo compounds may be stabilized by reacting their chlorides with metal halides, e.g., zinc chloride, cadmium chloride, tin chloride, etc., to form double salts, or by reacting with fluorine-containing acids, e.g., tetrafluoroboric acid, hexafluorophosphoric acid, fluorosulfuric acid, etc., or organic borates, e.g., sodium tetraborate, to form complex salts.

The azide compounds as photolyzable compounds preferably include aromatic azide compounds. Specific examples of the aromatic azide compounds are shown below.

(i)

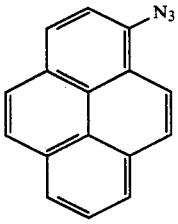

(ii)

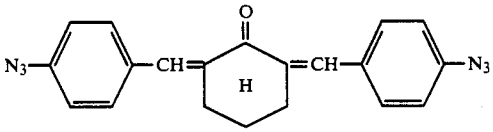

(iii)

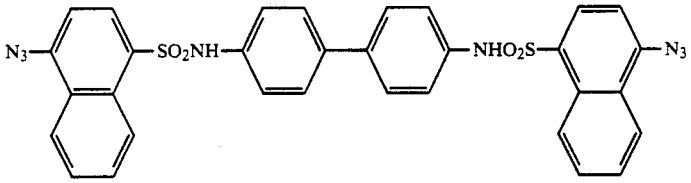

(iv)

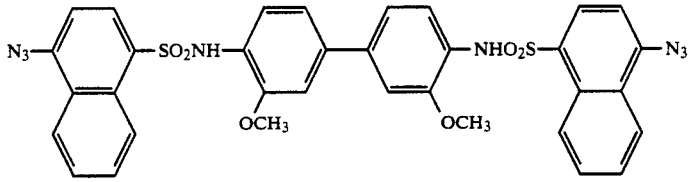

(v)

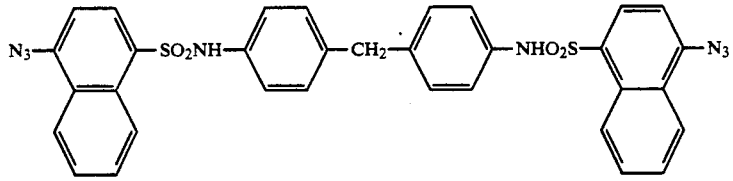

(vi)

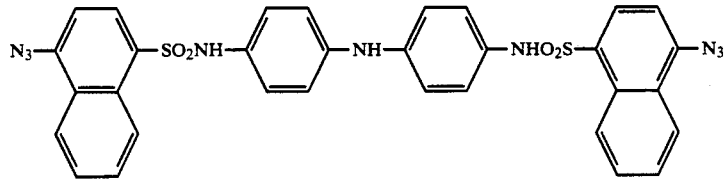

-continued

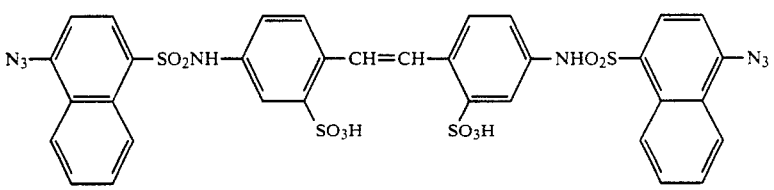

(vii)

Additional examples of the aromatic azide compounds are 4,4'-diazidodiphenylsulfone, 4,4'-diazidobenzosulfone, 4,4'-diazidostilbene, 4,4'-diazidobenzalacetone, 2,6-di(4-azidobenzal)-4-methylcyclohexanone, 4,4'-diazidodiphenyl sulfide, 1,2-(4,4'-diazidodiphenyl)-ethane, 4,4'-diazidodiphenyl ether, azidobenzoxazole, 4,4'-diazidodiphenylmethane, sodium 4,4'-diazidostilbene-2,2'-disulfonate, azidobenzoic acid, azidobenzenesulfonic acid, etc. If desired, these azide compounds may be optically sensitized with sensitizers to improve photosensitivity for practical use.

The above-described diazo compounds and azide compounds can be used either individually or in combination of two or more thereof.

The amount of the photolyzable compound to be incorporated ranges from 0.1 to 80 parts by weight, preferably from 5 to 50 parts by weight, per 100 parts by weight of the total solids content of the interlayer.

In the case where the transfer recording medium of the present invention which contains no light-heat converting layer is applied to color transfer recording or to black-and-white transfer recording aiming at an improvement on transfer properties, the interlayer may further contain a light-heat converting substance.

The light-heat converting substance to be incorporated in the interlayer is essentially required to absorb a light energy including ultraviolet rays, visible rays, infrared rays, etc. over a broad wavelength region and to effectively convert the light energy to heat energy. Such substances include organic or inorganic pigments or dyes, ultraviolet light absorbents, infrared light absorbents, and the like. Specific examples of these light-heat converting substances are inorganic pigments such as carbon black, graphite, metal powders (e.g., iron powder, copper powder, chromium powder, aluminum powder, etc.), and oxides, sulfides, selenides, ferrocyanides, chromates, or silicates of metals; organic pigments such as azo pigments, color lake pigments, nitro pigments, nitroso pigments, phthalocyanine pigments, metal complex pigments, perylene pigments, isoindolinone pigments, and quinacridone pigments; dyes such as nitron dyes, nitro dyes, azo dyes, stilbene-azo dyes, triphenylmethane dyes, xanthene dyes, quinoline dyes, thiazole dyes, azine dyes, oxazine dyes, sulfur dyes, anthraquinone dyes, indigoid dyes, phthalocyanine dyes, etc.; ultraviolet light absorbents such as quenchers (e.g., salicylic acids, benzotriazoles, cyanoacrylates, benzophenones, nickel dibutyldithiocarbamates, benzoates, etc.) and hindered amines; and commercially available infrared light absorbents (e.g., IR Absorber® PA-1001, 1005, and 1006 produced by Mitsui Toatsu Chemicals, Ind., and IRF-905 and 700 produced by Fuji Photo Film Co., Ltd.).

These light-heat converting substances may be used either individually or in combination of two or more thereof. The amount of the light-heat converting substance to be incorporated in the interlayer ranges from 1 to 50 parts by weight, preferably from 3 to 30 parts by weight, per 100 parts by weight of the total solids content of the interlayer.

If desired, the interlayer may contain a heat-fusible substance in order to amplify the pressurizing effect of nitrogen gas produced by photolysis of the photolyzable compound. The heat-fusible substance to be used is selected from compounds that are compatible with the binder and photolyzable compound and are melted or softened by the heat energy to thereby accelerate thermal expansion of nitrogen gas produced upon photolysis of the photolyzable compound.

Specific examples of such heat fusible substances are higher fatty acid amides (e.g., lauramide, stearamide, N-behenylbenzamide, etc.), aromatic carboxylic acid amides, higher fatty acids (e.g., lauric acid, stearic acid, oleic acid, etc.) or esters thereof, polyethylene glycol, polyethylene oxide, polyethylene oxide/polypropylene oxide graft copolymers, and the like.

If desired, a plasticizer such as phthalic esters, glycol esters, epoxy polymers, polyesters, vinyl polymers, etc. may be added to the interlayer to impart plasticity. Further, a dispersing agent, a pigment, a surface active agent, a hardening agent, a catalyst, and the like may be added to improve dispersibility or film-forming properties of the interlayer. Furthermore, a releasing agent may be added to the interlayer for the purpose of improving releasing properties on separation between the recording medium and the image-receiving sheet after transfer recording.

A coating composition for the interlayer can be prepared by dissolving or dispersing the above-described binder, photolyzable compound, light-heat converting substance and, if necessary, various additives in an appropriate solvent by means of a planetary mixer, a butterfly mixer, a sand mill, a tank mixer, an attritor, a three-roll mill, a vibrator mill, a jet mill, etc. The resulting coating composition is coated on the light transmitting support by the solvent coating technique by means of an air doctor coater, a blade coater, a rod coater, a knife coater, a squeeze coater, an impregnation coater, a reverse roll coater, a transfer roll coater, a gravure coater, a kiss-roll coater, etc. The thickness of the interlayer is in the range of from 0.01 to 20 μm and preferably from 0.1 to 10 μm.

Any of the binders generally used for coating can be used in the light-heat converting layer, with thermoplastic resins, rubbers, and thermosetting resins being preferred. The thermoplastic resins and rubbers to be used can be selected from those enumerated for the interlayer. Examples of the thermosetting resins to be used include unsaturated polyester resins, epoxy resins, xylene resins, polyamide imide resins, silicone resins, polyimide resins, polyurethane resins, olefin resins, allyl resins, melamine resins, furan resins, urea resins, phenolic resins, phenol-formaldehyde resins, urea-melamine resins, alkyd resins, etc. These binders may be used either individually or in combination of two or more thereof. The binders which can be used in this invention, however, are not limited to the above-enumerated specific examples.

The light-heat converting substances include organic or inorganic pigments or dyes, ultraviolet light absorbents, and infrared light absorbents. Specific examples of these light-heat converting substances are the same as those recited for the interlayer. These substances may be used either individually or in combination of two or more thereof. The amount of the light-heat converting substance to be used in the light-heat converting layer ranges from 1 to 50 parts by weight, preferably from 3 to 30 parts by weight, per 100 parts by weight of the total solids content in the light-heat converting layer.

A solvent which can be used in the preparation of a coating composition of the light-heat converting layer can be selected from those commonly employed for coating as long as it is capable of dissolving or dispersing the binder and the light-heat converting substance without corroding the interlayer upon coating to impair the characteristics of the photolyzable compound present in the interlayer. Examples of such solvents are aliphatic hydrocarbons, aromatic hydrocarbons, halogenated hydrocarbons, alcohols, ethers, ketones, esters, nitriles, carbon disulfide, water, and so on.

The aforesaid binder, light-heat converting substance, and if desired, various additives such as a dispersing agent, a surface active agent, a hardening agent, a catalyst, and a releasing agent are dissolved or dispersed in the solvent in the same manner as for the interlayer to prepare a coating composition for the light-heat converting layer. Coating on the interlayer can be carried out by the solvent coating technique in the same manner as for the coating of the interlayer. The thickness of the light-heat converting layer suitably ranges from 0.01 to 10 μm and preferably from 0.1 to 5 μm.

The light reflecting layer which may be provided on the back side of the light transmitting support is formed by vacuum evaporation of a metal easily destroyable by electrical discharge, e.g., aluminum ,zinc, indium, tin, etc. In order to improve discharge recording properties, it is preferable to provide a highly transparent surface roughening layer containing fine particles of silica, alumina, tin dioxide, alumina hydrate, etc. between the support and the light reflecting layer.

The heat transfer solid ink layer is composed of heat-fusible or heat-subliming materials generally employed in the field of heat tranfer ink sheet.

The heat-fusible ink layer is mainly composed of a low-melting binder, a coloring agent, and a softening agent. The low-melting binder is a solid or semi solid substance having a melting point between 40° C. and 120° C. Examples of such a low-melting binder are waxes (e.g., carnauba wax, paraffin wax, microcrystalline wax, ester waxes, oxidized waxes, montain wax, etc.); higher fatty acids (e.g., stearic acid, behenic acid, etc.); higher alcohols (e.g., palmityl alcohol, stearyl alcohol, etc.); higher fatty acid esters (e.g., cetyl palmitate, cetyl stearate, etc.); amides (e.g., acetamide, stearamide, etc.); rosin derivatives (e.g., ester gum, rosin-phenol resins, etc.); high-molecular weight compounds (e.g., terpene resins, cyclopentadiene resins, etc.); higher amines (e.g., stearylamine, palmitinamine, etc.); polyethylene glycol; polyethylene oxide; and so on. These low-melting substances may be used either individually or in combination of two or more thereof.

The coloring agents to be used can be selected from conventionally known dyes or pigments such as cyan dyes (e.g., Diacelliton® Fast Brilliant Blue R (produced by Mitsubishi Chemical Industries, Ltd.), Kayalon® Polyester Blue B-SF Conc (produced by Nippon Kayaku Co., Ltd.), etc.); magenta dyes (e.g., Diacelliton® Fast Red R (produced by Mitsubishi Chemical Industries, Ltd.), Kayalon® Polyester Pinc RCL-E (produced by Nippon Kayaku Co., Ltd.), etc.); yellow dyes (e.g., Kayalon® Polyester Light Yellow 5G-S (produced by Nippon Kayaku Co., Ltd.), Aizen® Spiron Yellow GRH (produced by Hodogaya Chemical Co., Ltd.), etc.); cyan pigments (e.g., cerulean blue, Phthalocyanine Blue, etc.); magenta pigments (e.g., Brilliant Carmine, Alizarine Lake, etc.); yellow pigments (e.g., Hansa Yellow, Bisazo Yellow, etc.); and black pigments (e.g., carbon black, graphite, Oil Black, etc.).

If desired, the heat-.fusible ink layer may further contain a thermoplastic resin (e.g., an ethylene/vinyl acetate copolymer, a butyral resin, a polyamide resin, a rosin resin, etc.), a plasticizer, an oil (e.g., a mineral oil, a vegetable oil, etc.), and the like.

On the other hand, the heat-subliming ink layer is mainly composed of a binder and a heat subliming dye. When it is intended to evaporate and transfer the subliming dye only, the binder to be used preferably has a relatively high melting point or softening point in order to avoid the melting and transfer of the binder. Examples of such a binder include organic solvent-soluble resins (e.g., polysulfones, polycarbonates, polyesters, polyphenylene oxides, cellulose derivatives, etc.); water-soluble or water-dispersible resins (e.g., polyvinyl alcohol, polyvinyl butyral, hydroxyethyl cellulose, carboxymethyl cellulose, water-soluble or water-dispersible polyesters, water-soluble or water-dispersible acrylic resins, etc.); and emulsions of the above-described organic solvent-soluble resins. When both the subliming dye and the binder are to be transferred, the same binder as enumerated for the aforesaid heat-fusible ink layer can be employed.

The heat-subliming dye to be used can be selected from disperse dyes, oil-soluble dyes, acid dyes, mordant dyes, vat dyes, basic dyes, and the like that are generally employed for textile printing or heat transfer inks. Examples of these dyes are azo dyes, anthraquinone dyes, nitro dyes, styryl dyes, naphthoquinone dyes, quinophthalone dyes, azomethine dyes, coumarin dyes, condensed polycyclic dyes, etc. These dyes preferably start to sublime at a temperature of 150° C. or lower.

If desired, the heat transfer solid ink layer may further contain an anti-blocking agent, an organic or inorganic pigment, an antioxidant, an ultraviolet light absorbent, an antistatic agent, a surface active agent, a cross-linking agent, a catalyst, and the like.

The heat transfer solid ink layer can be formed by the hot melt coating method or solvent coating method to a thickness of from 0.1 to 10 μm and preferably from 1 to 5 μm.

In addition to the above-described layer structure, a releasing layer may be provided between the heat transfer solid ink layer and the interlayer or the light-heat converting layer, or an adhesive layer comprising a polymer may be provided on the heat transfer solid ink layer in order to improve the contact with the image-receiving sheet.

An image-receiving sheet which is used in the heat transfer recording method is generally required to be not only high in surface smoothness but also low in air permeability (i.e., low in denseness) in the cross-sectional direction thereof in order to improve the adhesiveness of an ink. However, the image-receiving sheet which can be used in this invention is less restricted in terms of surface smoothness and air permeability, and there are employable papers and sheet-like materials to a considerably large extent. For example, there can be used standard heat transfer papers having a Bekk smoothness of from 200 to 1,000 seconds; PPC copying papers having a Bekk smoothness of from 20 to 100 seconds; bond papers having a rough surface such that the Bekk smoothness is from 1 to 10 seconds, which are widely used for the business purpose in Europe and America; and polyethylene terephthalate film having a Bekk smoothness of 10,000 seconds or longer. In these cases, the thickness of the image-receiving sheet is preferably from about 50 to 150 μm from the viewpoint of handling.

Further, in order to obtain recorded images of more high-quality full color, it is preferred that an ink-receiving layer is provided on the surface of a paper as the substrate to prepare an image-receiving sheet, to thereby delicately control the ink receptivity of the transferred ink. The ink-receiving layer can be formed by dispersing an inorganic pigment (e.g., calcium carbonate or silica) or an organic pigment (e.g., polystyrene or polyacrylate) in a binder and then subjecting the dispersion to a solvent coating process. In particular, when the coloring material cf the ink layer is of a dye type, the use of, as the binder, polyesters, polyamides, or various other setting resins gives rise to a marked improvement in storage stability of the transferred image because of high dyeability of the dye.

The method of transfer recording by using the above-described transfer recording media will be explained below.

Figure 6:
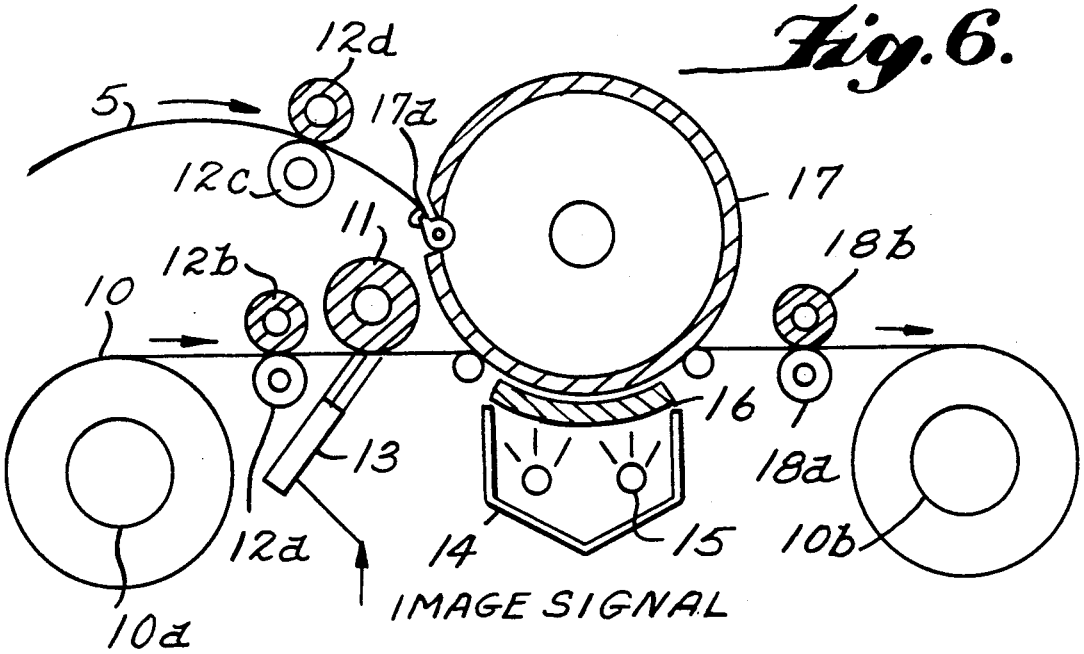

FIG. 6 shows a process for carrying out the transfer recording according to the present invention by using the transfer recording medium shown in FIG. 5-(*c*) or (*d*). In FIG. 6, transfer recording medium 10 wound on supply drum 10*a* with its light reflecting layer being inside is forwarded via rollers 12*a* and 12*b* to a position between discharge destruction recording head 13 and platen 11, where the light reflecting layer is selectively discharge destroyed according to an image signal applied to the head 13. The roller 12*a* serves also as a ground electrode for the discharge destruction recording. Image-receiving sheet 5 (such as a plain paper, a plastic sheet, etc ) is fed via rollers 12*c* and 12*d* and gripped with claw member 17*a* provided on transfer drum 17, to be wound on the drum 17 with the rotation of the drum 17. The heat transfer solid ink layer is brought into intimate contact with the image-receiving sheet 5 and then forwarded to a position between the transfer drum 17 and glass plate 16 pressed onto the transfer drum 17, where a flash light emitted from flash lamp 15 (e.g., a xenon lamp, an iodine lamp, etc.) equipped with reflector 14 irradiates the recording medium from the side of the light reflecting layer. By this irradiation, the heat transfer solid ink layer in the areas corresponding to the destroyed areas of the light reflecting layer is molten and transferred to the image-receiving sheet 5 by the light-heat conversion function of the recording medium. The transfer recording medium after the molten ink is transferred to the image-receiving sheet 5 is stripped off from the image-receiving sheet 5 because the image-receiving sheet 5 is wound on the transfer drum 17 and the recording medium 10 is forwarded via rollers 18*a* and 18*b* to be wound on take-up drum 10*b*. A black and-white, or monochromatic, transferred image can thus be obtained on the image-receiving sheet 5, which is released from the transfer drum 17 by loosening the claw member 17*a*. In FIG. 6, the crosshatched portions except the glass plate 16 mean those whose entire or surface portions are covered by rubber.

On the other hand, when a multi-color or full color image is desired, the same process as described above in connection with FIG. 6 is repeated three or four times to overlap a yellow ink, a magenta ink, a cyan ink, and if necessary, a black ink in accordance with a subtractive color process.

Figure 7:
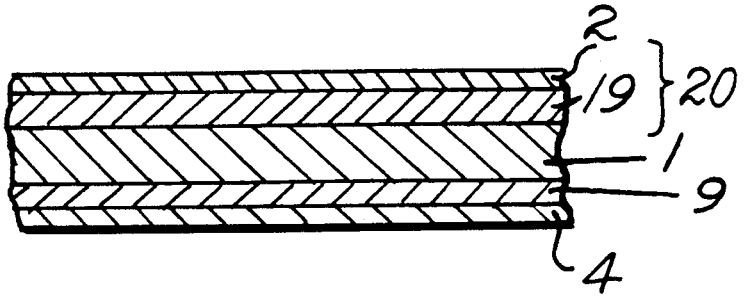

In the case where the process of FIG. 6 is applied to the transfer recording medium having no light reflecting layer as shown in FIG. 5-(*a*) or (*b*), mask sheet 20 composed of transparent support 19 and light reflecting layer 2 as shown in FIG. 7 is prepared, and the transparent support 19 and the light transmitting support 1 of the transfer recording medium are brought into contact with each other. The resulting composite sheet is wound up with the light reflecting layer 2 of the mask sheet 20 being inside and subjected to the process of FIG. 6.

The means for imagewise destroying the light reflecting layer is not limited to electrical discharge as adopted in FIG. 6 and may be carried out by, for example, a peel-apart method utilizing a photopolymer.

Figure 8A:
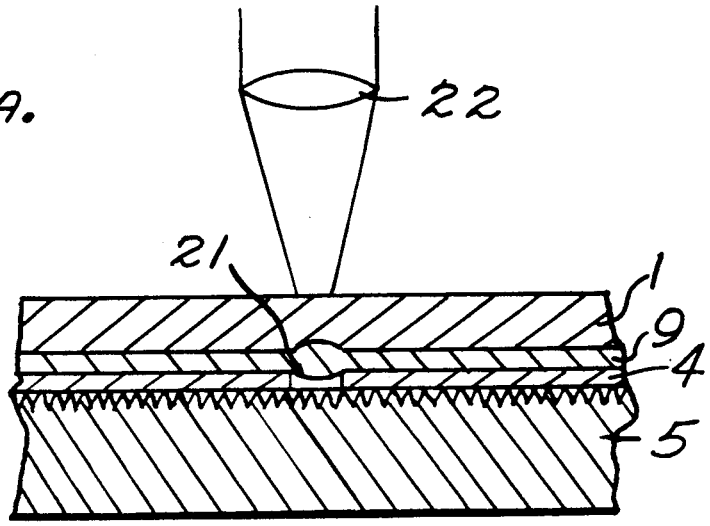
Figure 8B:
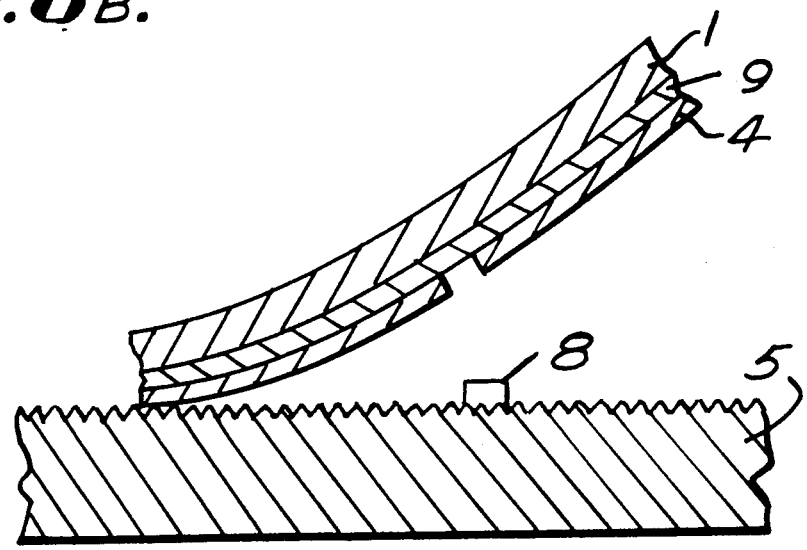

Another embodiment for carrying out the transfer recording using the transfer recording medium having no light reflecting layer is illustrated in FIG. 8. In FIG. 8-(*a*), the surface of the light transmitting support 1 is irradiated with scanning laser beam 23 which is imagewise controlled and condensed by condensing lens 22. The laser to be used includes a YAG laser, a helium-cadmium laser, an argon ion laser, a krypton laser, an excimer laser, a nitrogen laser, a metal deposit laser, a carbonic acid gas laser, a dyestuff laser, a semi-conductor laser, etc.

The laser beam energy is absorbed by the light-heat converting substance constituting the interlayer 9 and converted to a heat energy, whereby the heat transfer solid ink layer 4 at the irradiated area becomes molten ink 21 ready to be transferred to the image-receiving sheet 5. The transfer recording medium and the image-receiving sheet 5 are then separated apart to thereby transfer image 8 comprising the heat transfer solid ink onto the image-receiving sheet 5 as shown in FIG. 8-(*b*).

During the above-described process, the photolyzable compound present in the interlayer is decomposed upon light irradiation to produce a gas to thereby volume expand the interlayer. As a result, a pressurizing effect is exerted on the heat transfer solid ink in the area corresponding to the irradiated area toward the image-receiving sheet to thereby assure transfer of the ink to the image-receiving sheet.

The present invention will now be illustrated in greater detail by way of the following examples, but it should be understood that the present invention is not deemed to be limited thereto. In these examples, all the parts and percents are by weight.

EXAMPLE 1

Formation of Interlayer

| | |
|---|---|
| Binder: | |
| 25% cyclohexanone solution of | 200 parts |

-continued

| | |
|---|---|
| Mitec ® MX-4001 (a trade name of polyurethane resin produced by Mitsubishi Chemical Industries, Ltd.) | |
| Photolyzable compound: | |
| 4-Diazo-1-morpholino-2,5-dibutoxybenzene tetrafluoroborate | 35 parts |

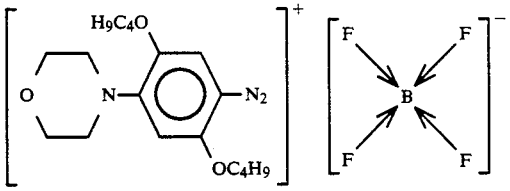

| | |
|---|---|
| Light-heat converting substance: | |
| 15% toluene dispersion of Multilac ® A-903 Black (a trade name of carbon dispersion produced by Toyo Ink Mfg. Co:, Ltd.) | 100 parts |
| Solvent: | |
| Methyl ethyl ketone | 665 parts |

To a mixed solution of the above components were added glass beads, and the mixture was dispersed in a paint shaker for 100 minutes to prepare a coating composition for an interlayer. The resulting composition was coated on a 6 μm-thick polyethylene terephthalate film with a wire bar and dried at 75° C. for 1 minute to form an interlayer having a dry thickness of 1.4 μm.

Formation of Heat Transfer Solid Ink Layer

| | |
|---|---|
| (A) Yellow Ink (Y) | |
| Binder: | |
| Carnauba wax (melting point: 73° C.) | 12 parts |
| Paraffin wax (melting point: 60° C.) | 20 parts |
| Additive: | |
| Oleic acid | 9 parts |
| Pigment: | |
| Bisazo Yellow | 9 parts |
| (B) Magenta Ink (M) | |
| Binder: | |
| Carnauba wax (melting point: 73° C.) | 12 parts |
| Paraffin wax (melting point: 60° C.) | 20 parts |
| Additive: | |
| Oleic acid | 9 parts |
| Pigment: | |
| Brilliant Carmine | 9 parts |
| (C) Cyan Ink (C) | |
| Binder: | |
| Carnauba wax (melting point: 73° C.) | 12 parts |
| Paraffin wax (melting point: 60° C.) | 20 parts |
| Additive: | |
| Oleic acid | 9 parts |
| Pigment: | |
| Phthalocyanine Blue | 9 parts |
| (D) Black Ink (BK) | |
| Binder: | |
| Carnauba wax (melting point: 73° C.) | 12 parts |
| Paraffin wax (melting point: 60° C.) | 20 parts |
| Additive: | |

-continued

| | |
|---|---|
| Oleic acid | 9 parts |
| Pigment: | |
| Carbon black | 9 parts |

A mixture having each of the formulations (A), (B), (C), and (D) was melt kneaded at 95° C. and stirred in a homomixer for 60 minutes to prepare heat-fusible inks (Y), (M), (C), and (BK). Inks (Y), (M), (C), and (BK) had a melting point of 75° C., 74° C., 72° C., and 69° C., respectively and a melt viscosity of 126 cp, 34 cp, 22 cp, and 120 cp, respectively, at 100° C. Each of these inks was coated on the interlayer by the hot melt coating technique to form a heat transfer solid ink layer having a thickness of 3.5 μm. There were thus obtained four kinds of transfer recording media each having an ink layer of (Y), (M), (C), or (BK).

Onto a 12 μm-thick light transmitting support comprising polyethylene terephthalate was formed a 6 μm-thick surface roughening layer containing silica ($SiO_2$) having an average particle size of 5 μm, and an aluminum deposit of about 500 Å was formed on the surface roughening layer by vacuum evaporation to obtain a mask sheet having a light reflecting layer which was removable by the discharge destruction recording.

A character pattern, a solid pattern, and a tone pattern based on the dither method were recorded on the mask sheet by means of an ordinary electric discharge recording device at a head voltage of 45 V to be applied, to prepare a negative image. The polyethylene terephthalate layer of the mask sheet and the back side of each of the above-prepared transfer recording media, i.e., the polyethylene terephthalate layer, were brought into contact with each other and, at the same time, an image-receiving sheet was intimately contacted with the heat transfer solid ink layer of the transfer recording medium. Then, a flash light was irradiated on the entire surface of the recording medium from the side of the light reflecting layer of the mask sheet. During the light irradiation, the contact pressure between the ink layer and the image-receiving sheet was set at 50 g/cm$^2$ or 100 g/cm$^2$ (hereinafter the same), and the flash light energy was fixed at 13 mJ/mm$^2$. The image-receiving sheet used in this example and the subsequent examples was bond paper, copying paper, or heat transfer paper having a Bekk's surface smoothness of from 4 to 6 seconds, from 50 to 60 seconds, or from 300 to 320 seconds, respectively.

After the transfer recording, the transfer recording medium and the image-receiving sheet were separated apart at a peel angle of 180° to thereby obtain a transferred color image on the image-receiving sheet.

EXAMPLE 2

An image-receiving sheet was intimately contacted with the heat transfer solid ink layer of each of the transfer recording media as prepared in Example 1, and an argon ion laser beam having a beam diameter of 10 μm was irradiated on the medium from the side of the polyethylene terephthalate support at a scanning rate of 10 m/sec. The transfer recording medium and the image-receiving sheet were separated apart to obtain a transferred color image on the image receiving sheet.

EXAMPLE 3

Formation of Interlayer

| | |
|---|---|
| Binder: | |
| 35% toluene/isopropyl alcohol solution of Takelac ® E-366 (a trade name of polyurethane resin produced by Takeda Chemical Industries, Ltd.) | 171 parts |
| Photolyzable compound: | |
| 4-Diazo-1-diethylamino-2-(4'-chlorophenoxy)-5-chlorobenzene hexafluorophosphate | 40 parts |

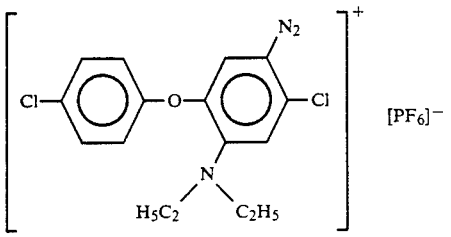

| | |
|---|---|
| Solvent: | |
| Methyl ethyl ketone | 456 parts |

Glass beads were added to a mixed solution consisting of the above components, and the mixture was dissolved and dispersed in a paint shaker for 100 minutes to prepare a coating composition. The composition was coated on a 6 μm-thick polyethylene terephthalate film with a wire bar and dried at 75° C. for 1 minute to form an interlayer having a dry thickness of 2 μm.

Formation of Light-Heat Converting Layer

| | |
|---|---|
| Binder: | |
| 30% toluene solution of Vyron ® 300 (a trade name of saturated polyester resin produced by Toyobo Co., Ltd.) | 117 parts |
| 30% methyl ethyl ketone solution of Vinylite Resin ® VAGH (a trade name of soluble vinyl chloride resin produced by Union Carbide Corp.) | 117 parts |
| Light-heat converting substance: | |
| Multilac ® A-903 Black | 60 parts |
| Solvent: | |
| Toluene | 106 parts |

Glass beads were added to a mixed solution of the above components, and the mixture was dissolved and dispersed in a paint shaker for 100 minutes to prepare a coating composition for a light-heat converting layer. The composition was coated on the interlayer with a wire bar and dried at 90° C. for 1 minute to form a light-heat converting layer having a thickness of 1.5 μm.

A heat transfer solid ink layer was then formed on the light-heat converting layer in the same manner as described in Example 1 to obtain four kinds of color transfer recording media.

Transfer recording was carried out on the resulting recording media in the same manner as in Example 1 to obtain a transferred color image on each of the image-receiving sheets.

EXAMPLE 4

Formation of Light Reflecting Layer

A surface roughening layer containing silica ($SiO_2$) having an average particle size of 5 μm was formed on a 12 μm-thick polyethylene terephthalate film to a thickness of 6 μm, and aluminum was then vacuum deposited onto the surface roughening layer to a deposit thickness of about 500 Å to form a light reflecting layer which was removable by the electric discharge recording.

Formation of Interlayer

| | |
|---|---|
| Binder: | |
| 20% methyl ethyl ketone solution of Denka Vinyl ® 1000 As (a trade name of vinyl chloride/vinyl acetate copolymer resin produced by Denki Kagaku Kogyo K. K.) | 325 parts |
| Diazo compound: | |
| 4-Diazo-1-morpholino-2,5-dibutoxybenzene tetrafluoroborate | 35 parts |

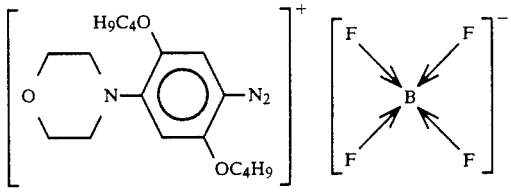

| | |
|---|---|
| Solvent: | |
| Methyl ethyl ketone | 307 parts |

Glass beads were added to a mixed solution comprising the above components, and the mixture was dissolved and dispersed in a paint shaker for 100 minutes to prepare a coating composition for an interlayer. The composition was coated on the other side of the polyethylene terephthalate film (i.e., opposite to the light reflecting layer) with a wire bar and dried at 75° C. for 1 minute to form an interlayer having a dry thickness of 2 μm.

Formation of Heat Transfer Solid Ink Layer

| | |
|---|---|
| Binder: | |
| Carnauba wax (melting point: 73° C.) | 12 parts |
| Paraffin wax (melting point: 60° C.) | 20 parts |
| Additive: | |
| Oleic acid | 9 parts |
| Pigment: | |
| Carbon black | 9 parts |

A mixture of the above components was melt kneaded at 95° C. and stirred in a homomixer for 60 minutes to prepare a heat-fusible ink having a melting point of 69° C. and a melt viscosity of 120 cp at 100° C. The ink was coated on the interlayer by the hot melt coating technique to a thickness of 4 μm to obtain a transfer recording medium for black-and-white recording.

An image information was recorded on the resulting transfer recording medium by means of an electrical discharge recording device in the same manner as in Example 1. An image-receiving sheet was then contacted with the heat transfer solid ink layer, and a flash light was irradiated from the side of the light reflecting layer in the same manner as in Example 1. After the irradiation, the transfer recording medium and the image-receiving sheet were separated apart at a peel angle of 180° to obtain a transferred black image on the image-receiving sheet.

EXAMPLE 5

Formation of Interlayer

An interlayer containing a light-heat converting substance was formed on a support in the same manner as in Example 4 except for using the following formulation.

| | |
|---|---|
| Binder: | |
| 20% methyl ethyl ketone solution of Denka Vinyl ® 1000 As | 300 parts |
| Diazo compound: | |
| 4-Diazo-1-morpholino-2,5-dibutoxy-benzene tetrafluoroborate | 30 parts |
| Light-heat converting substance: | |
| Carbon black | 10 parts |
| Solvent: | |
| Methyl ethyl ketone | 327 parts |

Formation of Heat Transfer Solid Ink Layer

Each of Inks (Y), (M), and (C) as prepared in Example 1 was coated on the interlayer by the hot melt coating technique to a thickness of 3.5 μm to obtain three kinds of transfer recording media each having an ink layer of (Y), (M), or (C).

Transfer recording was carried out on each of the resulting media in the same manner as in Example 4 to obtain a transferred color image on the image-receiving sheet.

EXAMPLE 6

The same procedure of Example 5 was repeated except for using a coating composition having the following formulation as an interlayer to obtain transferred color images on image-receiving sheets.

Interlayer Formulation

| | |
|---|---|
| Binder: | |
| 20% toluene solution of Soalex ® R-BH (a trade name of ethylene/vinyl acetate copolymer resin produced by Nippon Synthetic Chemical Industry Co., Ltd.; vinyl acetate content: 55%) | 300 parts |
| Diazo compound: | |
| 4-Diazo-1-dimethylamino-2-(4'-chlorophenoxy)-5-chlorobenzene hexafluorophosphate | 30 parts |
| Light-heat converting substance: | |
| Carbon black | 10 parts |
| Solvent: | |
| Methyl ethyl ketone | 327 parts |

EXAMPLE 7

An interlayer containing a light-heat converting substance was formed on a support in the same manner as in Example 5.

Formation of Heat Transfer Solid Ink Layer

| | |
|---|---|
| Binder: | |
| Ethyl cellulose | 3 parts |
| Pigment: | |
| Nippseal ® E-200A (a trade name of white carbon produced by Nippon Silica K.K.) | 2 parts |
| Disperse dye: | |
| Kayaset ®-IO-A-G*, Kayaset ® Red B**, or Kayaset ® Blue 906*** | 10 parts |
| Solvent: | |
| Isopropyl alcohol | 45 parts |

*Yellow ink produced by Nippon Kayaku Co., Ltd.
**Magenta ink produced by Nippon Kayaku Co., Ltd.
***Cyan ink produced by Nippon Kayaku Co., Ltd.

Glass beads were added to a mixed solution of the above components, and the mixture was dispersed in a paint shaker for 120 minutes to prepare a heat-subliming ink (Y), (M), or (C). Each of the resulting inks was coated on the interlayer with a wire bar to a dry thickness of 3 μm and dried at 60° C. for 2 minutes to obtain a transfer recording medium.

Transfer recording was carried out on each of the resuslting recording media in the same manner as in Example 5 to obtain a transferred color image on the image-receiving sheet.

EXAMPLE 8

Formation of Light Reflecting Layer

A light reflecting layer which was removable by the electrical discharge destruction was formed on a 12 μm-thick polyethylene terephthalate film in the same manner as in Example 4.

Formation of Interlayer

| | |
|---|---|
| Binder: | |
| 20% methyl ethyl ketone solution of Nichigo Polyester ® LP-011 (a trade name of polyester resin produced by Nippon Synthetic Chemical Industry Co., Ltd.) | 300 parts |
| Photolyzable compound: | |
| 4-Diazo-1-diethylamino-2-(4'-chlorophenoxy)-5-chlorobenzene hexafluorophosphate | 40 parts |
| Solvent: | |
| Methyl ethyl ketone | 327 parts |

Glass beads were added to a mixed solution of the above components, and the mixture was dissolved and dispersed in a paint shaker for 100 minutes to prepare a coating composition for an interlayer. The composition was coated on the other side of the polyethylene terephthalate (i.e., opposite to the light reflecting layer) with a wire bar to a dry thickness of 2 μm and dried at 75° C. for 1 minute to form an interlayer.

Formation of Light-Heat Converting Layer

A light-heat converting layer was formed on the interlayer in the same manner as in Example 3 except that the dry thickness of the layer was changed to 2.5 μm. The peel strength between the thus formed interlayer and light-heat converting layer at a peel angle of 180° was 50 g/cm.

Formation of Heat Transfer Solid Ink Layer

Each of the heat-fusible inks (Y), (M), and (C) as prepared in Example 1 was coated on the light-heat converting layer by the hot melt coating technique to form a heat transfer solid ink layer having a thickness of 3.5 μm.

Transfer recording was carried out on each of the resulting transfer recording media in the same manner as in Example 1 to obtain a transferred color image on the image-receiving sheet.

EXAMPLE 9

Formation of Interlayer

An interlayer was formed on a support in the same manner as in Example 8 except for using the following formulation.

| | |
|---|---|
| Binder: | |
| 20% toluene solution of Himic ® 1070 (a trade name of micro-crystalline wax produced by Nippon Seiro Co., Ltd.) | 300 parts |
| Photolyzable compound: | |
| 4-Diazo-1-morpholino-2,5-dibutoxy-benzene tetrafluoroborate | 40 parts |
| Solvent: | |
| Methyl ethyl ketone | 327 parts |

Formation of Light-Heat Converting Layer

| | |
|---|---|
| Binder: | |
| 35% toluene/isopropyl alcohol solution of Takelac ® E-366 | 237 parts |
| Light-heat converting substance: | |
| MA-100 (a trade name of carbon powder produced by Mitsubishi Chemical Industries, Ltd.) | 12 parts |
| Conductive zinc flower (produced by Honsho Chemical K.K.) | 5 parts |
| Solvent: | |
| Toluene | 146 parts |

Glass beads were added to a mixed solution of the above components, and the mixture was dissolved and dispersed in a paint shaker for 200 minutes to prepare a coating composition. The composition was coated on the interlayer with a wire bar to a dry thickness of 2.5 μm and dried at 90° C. for 2 minutes to form a light-heat converting layer.

Transfer recording was carried out on the resulting transfer recording medium in the same manner as in Example 8 to obtain a transferred color image on the image-receiving sheet.

EXAMPLE 10

Three kinds of transfer recording media were obtained in the same manner as in Example 8 except for replacing the heat-fusible ink with a heat-subliming ink prepared as follows.

| | |
|---|---|
| Binder: | |
| Ethyl cellulose | 3 parts |
| Pigment: | |
| Nippseal ® E-200A | 2 parts |
| Disperse dye: | |
| Yellow Ink (Y): Kayaset ®-IO-A-G, Magenta Ink (M): Kayaset ® Red B, or Cyan Ink (C): Kayaset ® Blue 906 | 10 parts |
| Solvent: | |
| Isopropyl alcohol | 45 parts |

Glass beads were added to a mixed solution of the above components, and the mixture was dispersed in a paint shaker for 120 minutes to prepare a color heat-subliming ink (Y), (M), or (C). The ink was coated on the light-heat converting layer with a wire bar to a dry thickness of 3 μm and dried at 60° C. for 2 minutes to obtain a transfer recording medium.

Transfer recording was carried out on each of the resulting media in the same manner as in Example 8 to obtain a transferred color image on the image-receiving sheet.

COMPARATIVE EXAMPLE 1

Transfer recording media were obtained in the same manner as in Example 5 except that the photolyzable compound was excluded from the interlayer.

Transfer recording was carried out on each of the resulting media to obtain a transferred color image on the image-receiving sheet.

COMPARATIVE EXAMPLE 2

Transfer recording media were obtained in the same manner as in Example 8 except that the photolyzable compound was excluded from the interlayer.

Transfer recording was carried out on each of the resulting media to obtain a transferred color image on the image-receiving sheet.

Each of the magenta transferred images obtained in the foregoing Examples 1 to 3, Examples 5 to 10 and Comparative Examples 1 to 2 and the transferred black image obtained in Example 4 and their enlarged photographs (magnification: ×25 or ×50) were visually observed to evaluate the image quality as follow.

Disappearance, cuts, and scratches of fine line images, disappearance of solid areas, fog, and tone reproducibility were observed. Images which were entirely free from these defects, had a Macbeth reflective density of 1 or more in the solid area, and were satisfactory in tone reproduction were rated "exc.". Images which underwent at least one of these defects to a minor degree were rated "good". Images which underwent at least one of these defects to a relatively conspicuous degree were rated "poor". Images which underwent these defects to a conspicuous degree and had insufficient density in the solid area were rated "bad".

The results obtained are shown in Table 1 below.

TABLE 1

| Contact Pressure (g/cm²) | Image | Image-Receiving Sheet* | Example No. 1 | 2 | 3 | 4 | 5 | 6 | 7 | 8 | 9 | 10 | Comparative Example No. 1 | 2 |
|---|---|---|---|---|---|---|---|---|---|---|---|---|---|---|
| 50 | character | B | good | poor | good | poor | poor | good | poor | poor | poor | good | bad | bad |
| " | " | C | exc. | poor | exc. | exc. | exc. | exc. | exc. | exc. | exc. | exc. | bad | poor |

TABLE 1-continued

| Contact Pressure (g/cm²) | Image | Image-Receiving Sheet* | Example No. 1 | 2 | 3 | 4 | 5 | 6 | 7 | 8 | 9 | 10 | Comparative Example No. 1 | 2 |
|---|---|---|---|---|---|---|---|---|---|---|---|---|---|---|
| " | " | T | exc. | good | exc. | exc. | exc. | exc. | exc. | exc. | exc. | exc. | good | good |
| " | solid | B | good | poor | poor | poor | poor | good | poor | poor | good | good | bad | bad |
| " | " | C | exc. | poor | good | good | exc. | good | exc. | exc. | good | exc. | bad | poor |
| " | " | T | exc. | poor | exc. | exc. | exc. | exc. | exc. | exc. | exc. | exc. | poor | good |
| " | tone | B | good | poor | good | poor | poor | good | good | good | good | good | bad | bad |
| " | " | C | exc. | poor | exc. | exc. | exc. | good | exc. | exc. | exc. | exc. | bad | good |
| " | " | T | exc. | poor | exc. | exc. | exc. | exc. | exc. | exc. | exc. | exc. | poor | good |
| 100 | character | B | exc. | poor | good | good | exc. | good | exc. | good | good | exc. | bad | bad |
| " | " | C | exc. | good | exc. | exc. | exc. | good | exc. | exc. | exc. | exc. | poor | poor |
| " | " | T | exc. | exc. | exc. | exc. | exc. | exc. | exc. | exc. | exc. | exc. | good | exc. |
| " | solid | B | exc. | poor | exc. | exc. | exc. | good | exc. | exc. | exc. | exc. | bad | bad |
| " | " | C | exc. | poor | exc. | exc. | exc. | good | exc. | exc. | exc. | exc. | good | good |
| " | " | T | exc. | good | exc. | exc. | exc. | exc. | exc. | exc. | exc. | exc. | good | good |
| " | tone | B | exc. | poor | good | good | good | good | exc. | exc. | good | exc. | bad | bad |
| " | " | C | exc. | good | exc. | exc. | exc. | good | exc. | exc. | exc. | exc. | poor | poor |
| " | " | T | exc. | good | exc. | exc. | exc. | exc. | exc. | exc. | exc. | exc. | good | good |

Note: *B: Bond paper
C: Copying paper
T: Heat transfer paper

As can be seen from Table 1, the transfer recording media according to the present invention were proved to provide excellent images on an image-receiving sheet. When the same evaluation was made on yellow, cyan, and black transferred images, it was confirmed that the present invention produces the similar effects.

As described above, the recording method according to the present invention, though making use of transfer recording, succeeds to markedly broaden a choice of image-receiving sheets to be combined and makes it possible to produce a clear and high-quality image at high speed and low cost, thus promising for application to wider recording systems.

That is, the formation of an interlayer containing a photolyzable compound on a light transmitting support brings about marked enhancement of intimate and sure contact of a heat transfer solid ink layer onto an image-receiving sheet. As a result, a transferred image having high quality such as high resolving power and high density can be obtained on not only image-receiving sheets of high surface smoothness but also those of low surface smoothness. This promises a possibility of obtaining a full color image having high resolving power and high density by repeatedly transferring an ink image on another ink image having an uneven surface according to a subtractive color process.

Further, since an image information can be recorded by the electrical discharge recording in the case where a light reflecting layer which is removable by the discharge destruction recording is provided on the back side of a support, the recording process can be achieved with high resolving power at high speed, a recording head has high reliability, and the recording system is freed of maintenance.

Furthermore, since image qualities are not deteriorated even when a contact pressure between the recording medium and an image-receiving sheet is low, it would be possible to greatly reduce the size and cost of a recording device.

While the invention has been described in detail and with reference to specific embodiments thereof, it will be apparent to one skilled in the art that various changes and modifications can be made therein without departing from the spirit and scope thereof.

What is claimed is:

1. A transfer recording medium for transferring an image onto an image receiving sheet wherein light energy is converted to heat energy comprising:
   a) a light transmitting support;
   b) an interlayer provided on a first surface of said light transmitting support for converting light energy to heat energy, said interlayer containing a photolyzable compound uniformly disposed therein;
   c) a light reflecting layer provided on a second surface of said light transmitting support opposite said interlayer which is removable by electrical discharge destruction recording; and
   d) a heat transfer solid ink layer provided on said interlayer.

2. A transfer recording medium for transferring an image onto an image receiving sheet wherein light energy is converted to heat energy comprising:
   a) a light transmitted support;
   b) an interlayer provided on a first surface of said light transmitting support for converting light energy to heat energy, said interlayer containing a photolyzable compound uniformly disposed therein and a binder selected from thermoplastic resins, waxes, and rubbers;
   c) a light reflecting layer provided on a second surface of said light transmitting support opposite said interlayer which is removable by electrical discharge destruction recording; and
   d) a heat transfer solid ink layer provided on said interlayer.

3. A transfer recording medium for transferring an image onto an image receiving sheet wherein light energy is converted to heat energy comprising:
   a) a light transmitting support;
   b) an interlayer provided on a first surface of said light transmitting support for converting light energy to heat energy, said interlayer containing a photolyzable compound selected from diazo compounds and azide compounds uniformly disposed therein;
   c) a light reflecting layer provided on a second surface of said light transmitting support opposite said interlayer which is removable by electrical discharge destruction recording; and d) a heat transfer solid ink layer provided on said interlayer.

4. A transfer recording medium for transferring an image onto an image receiving sheet wherein light energy is converted to heat energy comprising:

a) a light transmitting support;

b) an interlayer provided on a first surface of said light transmitting support for converting light energy to heat energy, said interlayer containing a photolyzable compound uniformly disposed therein;

c) a light reflecting layer provided on a second surface of said light transmitting support opposite said interlayer which is removable by electrical discharge destruction recording; and d) a heat transfer solid ink layer is a heat-fusible solid ink layer or a heat-subliming ink layer provided on said interlayer.

5. A transfer recording medium for transferring an image onto an image receiving sheet wherein light energy is converted to heat energy comprising:

a) a light transmitting support;

b) an interlayer provided on a first surface of said light transmitting support for converting light energy to heat energy, said interlayer containing a photolyzable compound uniformly disposed therein;

c) a light reflecting layer provided on a second surface of said light transmitting support opposite said interlayer which is removable by electrical discharge destruction recording;

d) a heat transfer solid ink layer provided on said interlayer; and e) a highly transparent surface roughening layer provided between said light transmitting support and said light reflecting layer.

6. A transfer recording medium for transferring an image onto an image receiving sheet wherein light energy is converted to heat energy comprising:

a) a light transmitting support;

b) an interlayer provided on a first surface of said light transmitting support for converting light energy to heat energy, said interlayer containing a photolyzable compound uniformly disposed therein;

c) a light reflecting layer provided on a second surface of said light transmitting support opposite said interlayer which is formed by vacuum evaporation of a metal comprising aluminum, zinc, indium and tin and is removable by electrical discharge destruction recording; and d) a heat transfer solid ink layer provided on said interlayer.

7. A transfer recording medium for transferring an image onto an image receiving sheet wherein light energy is converted to heat energy comprising;

a) a light transmitting support;

b) an interlayer provided on a surface of said light transmitting support, said interlayer containing a photolyzable compound uniformly disposed therein;

c) a heat transfer solid ink layer provided on said interlayer; and d) a light-heat converting layer provided between said interlayer and said heat transfer solid ink layer.

8. A transfer recording medium according to claim 7, further comprising a light reflecting layer provided on a second surface of said light transmitting support opposite said interlayer which is removable by electrical discharge destruction recording.

9. A transfer recording medium according to claim 8, further comprising a highly transparent surface roughening layer provided between said light transmitting support and said light reflecting layer.

10. A transfer recording medium according to claim 8, wherein said light reflecting layer is formed by vacuum evaporation of a metal comprising aluminum, zinc, indium and tin.

11. A transfer recording medium according to claims 7 or 8, wherein said interlayer further comprises a binder selected from thermoplastic resins, waxes, and rubbers.

12. A transfer recording medium according to claims 7 or 8, wherein said photolyzable compound is selected from diazo compounds and azide compounds.

13. A transfer recording medium according to claims 7 or 8, wherein said heat transfer solid ink layer is a heat-fusible solid ink layer or a heat-subliming ink layer.

* * * * *